US010139142B2

(12) United States Patent
Tanaka et al.

(10) Patent No.: US 10,139,142 B2
(45) Date of Patent: Nov. 27, 2018

(54) REFRIGERATION CYCLE APPARATUS INCLUDING A PLURALITY OF BRANCH UNITS

(71) Applicant: Mitsubishi Electric Corporation, Tokyo (JP)

(72) Inventors: Kosuke Tanaka, Tokyo (JP); Yuji Motomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 300 days.

(21) Appl. No.: 15/027,443

(22) PCT Filed: Oct. 25, 2013

(86) PCT No.: PCT/JP2013/078942

§ 371 (c)(1),
(2) Date: Apr. 6, 2016

(87) PCT Pub. No.: WO2015/059814

PCT Pub. Date: Apr. 30, 2015

(65) Prior Publication Data

US 2016/0245561 A1 Aug. 25, 2016

(51) Int. Cl.
*F25B 41/04* (2006.01)
*F25B 13/00* (2006.01)
(Continued)

(52) U.S. Cl.
CPC ..... *F25B 41/046* (2013.01); *F24F 3/065* (2013.01); *F25B 5/02* (2013.01); *F25B 13/00* (2013.01);
(Continued)

(58) Field of Classification Search
CPC ..... F25B 2313/0231; F25B 2313/0233; F25B 2313/0291; F25B 2313/0311; F24F 3/065
See application file for complete search history.

(56) References Cited

U.S. PATENT DOCUMENTS 6,237,351 B1 * 5/2001 Itoh ..... B60H 1/00921 62/113
2003/0230107 A1 * 12/2003 Lee ..... F25B 13/00 62/324.6
(Continued)

FOREIGN PATENT DOCUMENTS

EP 2623887 A1 8/2013
EP 2629028 A1 8/2013
(Continued)

OTHER PUBLICATIONS

Extended European Search Report dated Jun. 13, 2017 issued in corresponding EP application No. 13895998.6.
(Continued)

*Primary Examiner* — Frantz Jules
*Assistant Examiner* — Nelson Nieves
(74) *Attorney, Agent, or Firm* — Posz Law Group, PLC

(57) ABSTRACT

An object is to provide a refrigeration cycle apparatus that does not cause unevenness of capacity among branch units and a failure in controlling a refrigerant circuit. At least one of branch units is a first branch unit having a minimum pressure loss in distribution of refrigerant in a high-pressure refrigerant pipe between a heat source unit and the branch units, and at least another one of the branch units is a second branch unit having a maximum pressure loss in distribution of refrigerant in the high-pressure refrigerant pipe between the heat source unit and the branch units. An opening degree of an expansion device is controlled in such a manner that a differential pressure between a refrigerant pressure detected by a high-pressure detecting device of the first branch unit and a refrigerant pressure detected by an intermediate-pressure detecting device is greater than or equal to a set value ΔPHM.

7 Claims, 7 Drawing Sheets

(51) Int. Cl.
*F24F 3/06* (2006.01)
*F25B 25/00* (2006.01)
*F25B 5/02* (2006.01)

(52) U.S. Cl.
CPC ..... *F25B 25/005* (2013.01); *F24F 2221/50* (2013.01); *F25B 2313/0231* (2013.01); *F25B 2313/0272* (2013.01); *F25B 2313/02741* (2013.01); *F25B 2600/2513* (2013.01); *F25B 2700/19* (2013.01)

(56) References Cited

U.S. PATENT DOCUMENTS

2004/0139755 A1* 7/2004 Han Park ..... F25B 5/02 62/199
2006/0254294 A1* 11/2006 Shimamoto ..... F24F 3/065 62/238.7
2010/0319376 A1* 12/2010 Kawano ..... F25B 13/00 62/238.6
2011/0048053 A1* 3/2011 Sekine ..... F25B 13/00 62/324.6
2011/0146339 A1* 6/2011 Yamashita ..... F24F 3/06 62/513
2011/0185754 A1* 8/2011 Yamashita ..... F24F 11/83 62/132
2011/0185756 A1* 8/2011 Yamashita ..... F24F 3/06 62/171
2011/0192183 A1* 8/2011 Ha ..... F25B 49/02 62/196.1
2012/0042674 A1* 2/2012 Takenaka ..... F24F 3/06 62/180
2012/0198879 A1* 8/2012 Motomura ..... F25B 13/00 62/238.7
2012/0291472 A1* 11/2012 Morimoto ..... F24F 1/26 62/324.6
2013/0133361 A1* 5/2013 Yamashita ..... F25B 5/00 62/502
2013/0233008 A1 9/2013 Yamashita et al.
2014/0026605 A1 1/2014 Ishimura et al.
2014/0083123 A1* 3/2014 Yamashita ..... F25B 13/00 62/222
2014/0150483 A1* 6/2014 Takayama ..... F25B 13/00 62/160
2014/0182329 A1 7/2014 Yamashita et al.
2015/0276243 A1* 10/2015 Gertis ..... F25B 25/005 62/228.1

FOREIGN PATENT DOCUMENTS

JP 05-172431 A 7/1993
JP 2003-130482 A 5/2003
WO 2010/050003 A1 5/2010
WO 2011/052055 A1 5/2011
WO 2011/064827 A1 6/2011
WO 2012/042573 A1 4/2012
WO 2012/160597 A1 11/2012
WO 2013069044 A1 5/2013

OTHER PUBLICATIONS

International Search Report of the International Searching Authority dated Jan. 28, 2014 for the corresponding International application No. PCT/JP2013/078942 (and English translation).

* cited by examiner

FIG. 3

| | COOLING ONLY | COOLING MAIN | HEATING MAIN | HEATING ONLY |
|---|---|---|---|---|
| FIRST EXPANSION DEVICES 7a AND 7b (FOR CONDENSER IN MIXED LOAD STATE) | SH CONTROL SHm=2 | SC CONTROL SCm=10 | SC CONTROL SCm=10 | SC CONTROL SCm=10 |
| SECOND EXPANSION DEVICES 8a AND 8b (FOR EVAPORATOR IN A MIXED LOAD STATE) | SH CONTROL SHm=2 | SH CONTROL SHm=2 + ΔPHMm=6.2k | SH CONTROL SHm=2 | SH CONTROL SCm=10 |
| THIRD EXPANSION DEVICES 9a AND 9b | × | × | ΔPHMm=6.2k | ΔPHMm=6.2k |
| ON-OFF VALVES 12a AND 12b | ○ | × | × | × |

P-H DIAGRAM IN COOLING MAIN OPERATION MODE

FIG. 8

| | COOLING ONLY | COOLING MAIN | HEATING MAIN | HEATING ONLY |
|---|---|---|---|---|
| FIRST EXPANSION DEVICES 7a AND 72-1 (FOR CONDENSER IN MIXED LOAD STATE) | SH CONTROL SHm=2 | SC CONTROL SCm=10 | SC CONTROL SCm=10 | SC CONTROL SCm=10 |
| SECOND EXPANSION DEVICES 8a AND 72-2 (FOR EVAPORATOR IN A MIXED LOAD STATE) | SH CONTROL SHm=2 | SH CONTROL SHm=2 + ΔPHMm=6.2k | SH CONTROL SHm=2 | SH CONTROL SCm=10 |
| THIRD EXPANSION DEVICES 9a AND 80 | × | × | ΔPHMm=6.2k | ΔPHMm=6.2k |
| ON-OFF VALVE 12a | ○ | × | × | × |

FIG. 9

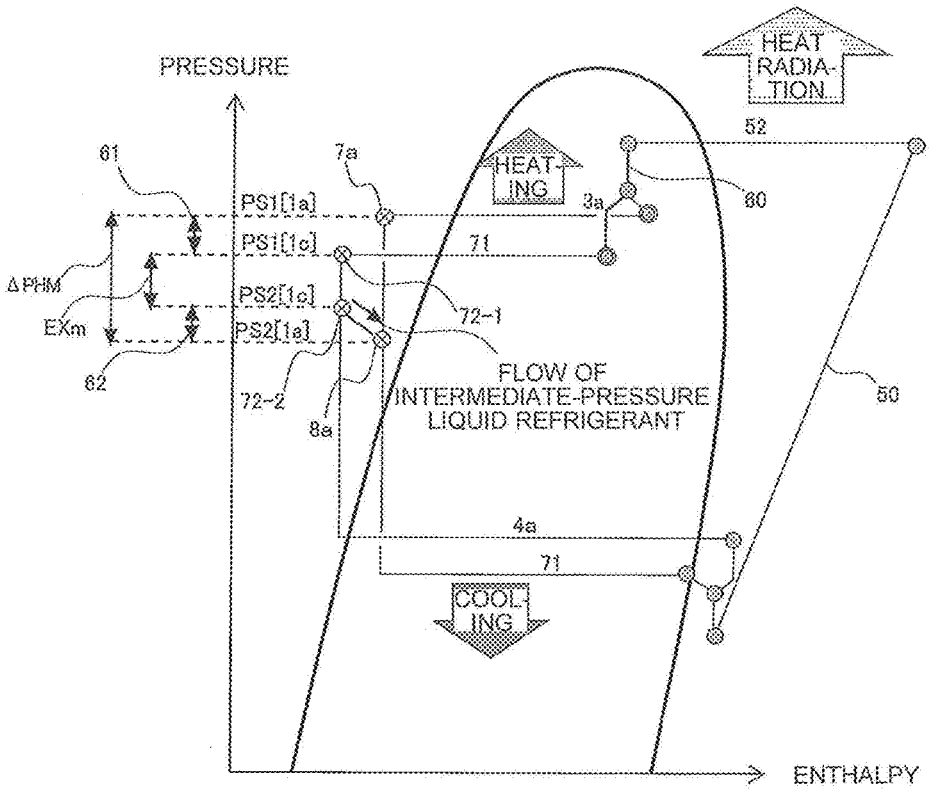

P-H DIAGRAM IN COOLING MAIN OPERATION MODE

REFRIGERATION CYCLE APPARATUS INCLUDING A PLURALITY OF BRANCH UNITS

CROSS REFERENCE TO RELATED APPLICATION

This application is a U.S. national stage application of PCT/JP2013/078942 filed on Oct. 25, 2013, the contents of which are incorporated herein by reference.

TECHNICAL FIELD

The present invention relates to a refrigeration cycle apparatus including a plurality of branch units for a heat medium.

BACKGROUND ART

As a conventional air-conditioning system uses a main branch unit and a plurality of sub-branch units serially connected to the main branch unit to supply a heat medium to indoor units in a multi-air-conditioning apparatus in which the indoor units are connected to one outdoor unit.

In this air-conditioning system, the main branch unit is connected to the sub-branch units by three refrigerant pipes in order to freely select a cooling operation and a heating operation in each of the indoor units, and each of the sub-branch units generates cooling energy and heating energy and supplies the cooling energy and the heating energy to the indoor units (see Patent Literatures 1 and 2).

CITATION LIST

Patent Literatures

Patent Literature 1: International Publication No. 2011-052055 (see, for example, FIGS. 6 to 9)

Patent Literature 2: International Publication No. 2011-064827 (see, for example, FIG. 9)

SUMMARY OF INVENTION

Technical Problem

In the conventional air-conditioning system, since the refrigerant pipes are connected to the sub-branch units through the main branch unit, the refrigerant pipes and crossover wiring for control inevitably become complicated, causes an increase in the amount of enclosed refrigerant and a problem in construction. In addition, since the main branch unit is serially connected to the sub-branch units by the refrigerant pipes, a large pressure loss occurs in distribution of refrigerant disadvantageously.

The present invention has been made to solve problems as described above, and provides a refrigeration cycle apparatus that does not cause uneven distribution of refrigerant among branch units and a failure in controlling an expansion device in a configuration of the refrigeration cycle apparatus including only the sub-branch units and eliminating the main branch unit.

Solution to Problem

A refrigeration cycle apparatus according to the present invention includes: a heat source unit including a compressor and an outdoor heat exchanger; a plurality of branch units each including a plurality of intermediate heat exchangers for performing heat exchange between refrigerant and a heat medium and a plurality of expansion devices for refrigerant associated with the intermediate heat exchangers; a plurality of use side units that receive the heat medium from the branch units; a refrigerant circuit including a high-pressure refrigerant pipe, a low-pressure refrigerant pipe, and an intermediate-pressure refrigerant pipe, the high-pressure refrigerant pipe and the low-pressure refrigerant pipe connecting the heat source unit to the branch units, the intermediate-pressure refrigerant pipe connecting the branch units to each other; a high-pressure detecting device that detects a pressure of the high-pressure refrigerant pipe in the branch units; and an intermediate-pressure detecting device that detects a pressure of the intermediate-pressure refrigerant pipe in the branch units, wherein at least one of the branch units is a first branch unit having a minimum pressure loss in distribution of refrigerant in the high-pressure refrigerant pipe connecting the heat source unit to the branch units, at least another of the branch units is a second branch unit having a maximum pressure loss in distribution of refrigerant in the high-pressure refrigerant pipe connecting the heat source unit to the branch units, and an opening degree of each of the expansion devices is controlled in such a manner that a differential pressure between a refrigerant pressure detected by the high-pressure detecting device of the first branch unit and a refrigerant pressure detected by the intermediate-pressure detecting device is greater than or equal to a set value.

Advantageous Effects of Invention

In the refrigeration cycle apparatus according to the present invention, an expansion device associated with an intermediate heat exchanger serving as an evaporator in a branch unit having a minimum pipe pressure loss from an outdoor unit is controlled so that high-pressure gas refrigerant can be supplied to a condenser in a branch unit having a maximum pipe pressure loss from the outdoor unit and that a minimum control differential pressure of an expansion device associated with the condenser can be obtained. In addition, since a plurality of branch units are connected to in parallel to the outdoor unit, a large number of indoor units can be connected to selectively perform cooling and heating operations, the configuration of refrigerant pipes and crossover wiring for control can be simplified as compared to a conventional configuration in which a main branch unit and sub-branch units are serially connected to an outdoor unit, and the amount of enclosed refrigerant can be reduced.

BRIEF DESCRIPTION OF DRAWINGS

FIG. 3 is a table showing opening and closing control of control valves in operation modes of the refrigeration cycle apparatus according to Embodiment 1.

FIG. 8 is a table showing opening and closing control of control valves in operation modes of the refrigeration cycle apparatus according to Embodiment 2.

FIG. 9 is a Mollier chart of the refrigeration cycle apparatus according to Embodiment 2 in a cooling main operation mode.

DESCRIPTION OF EMBODIMENTS

Figure 1:
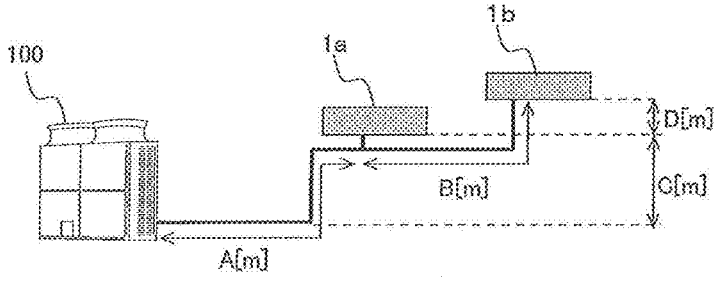
FIG. 1 illustrates an arrangement of an outdoor unit and branch units of a refrigeration cycle apparatus according to Embodiment 1.

A refrigeration cycle apparatus according to the present invention will be described hereinafter with reference to the drawings.

A configuration, for example, described below is merely an example, and the refrigeration cycle apparatus according to the present invention is not limited to the configuration, for example, described below.

In the drawings, the same reference signs denote the same or like members or parts, or alternatively, signs can be omitted.

The same or like description is simplified or is omitted as necessary.

Embodiment 1

FIG. 1 illustrates an arrangement of an outdoor unit and branch units of a refrigeration cycle apparatus according to Embodiment 1.

Figure 2:
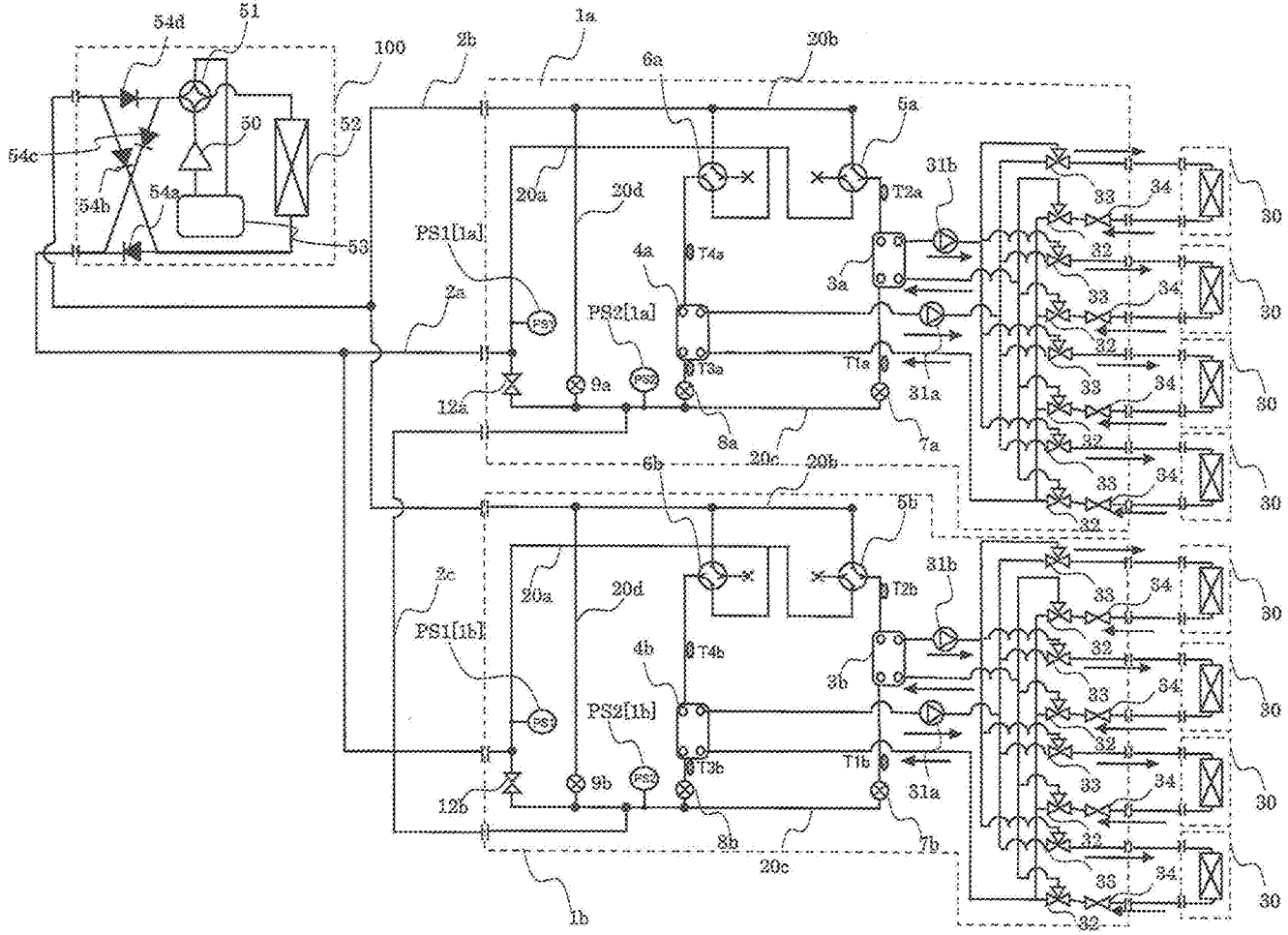
FIG. 2 is a refrigerant circuit diagram of the refrigeration cycle apparatus according to Embodiment 1.

FIG. 2 is a refrigerant circuit diagram of the refrigeration cycle apparatus according to Embodiment 1.

FIG. 3 is a table showing opening and closing control of control valves in operation modes of the refrigeration cycle apparatus according to Embodiment 1.

Figure 4:
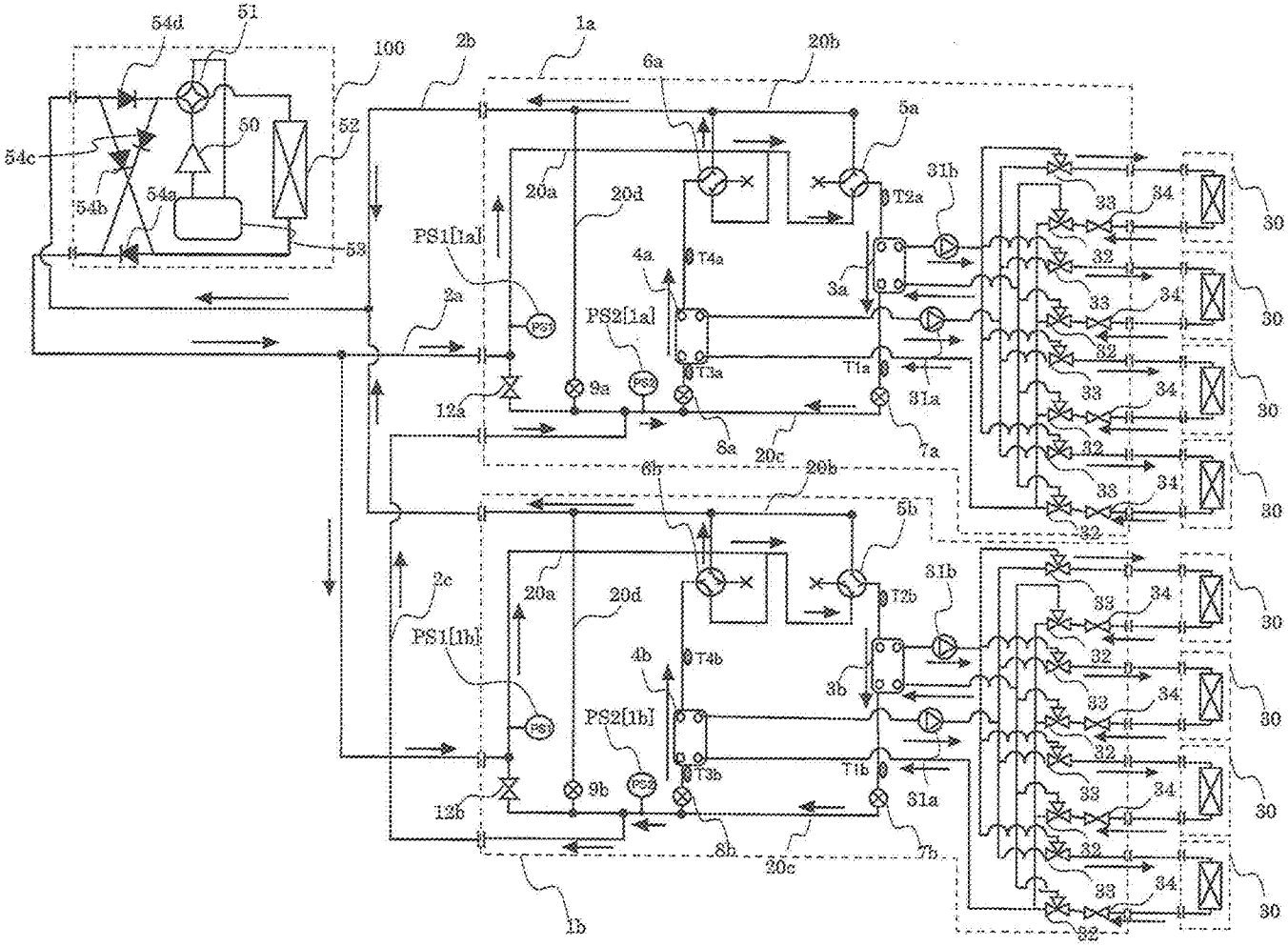
FIG. 4 illustrates a flow of refrigerant in a cooling main operation mode of the refrigeration cycle apparatus according to Embodiment 1.

FIG. 4 illustrates a flow of refrigerant in a cooling main operation mode of the refrigeration cycle apparatus according to Embodiment 1.

Figure 5:
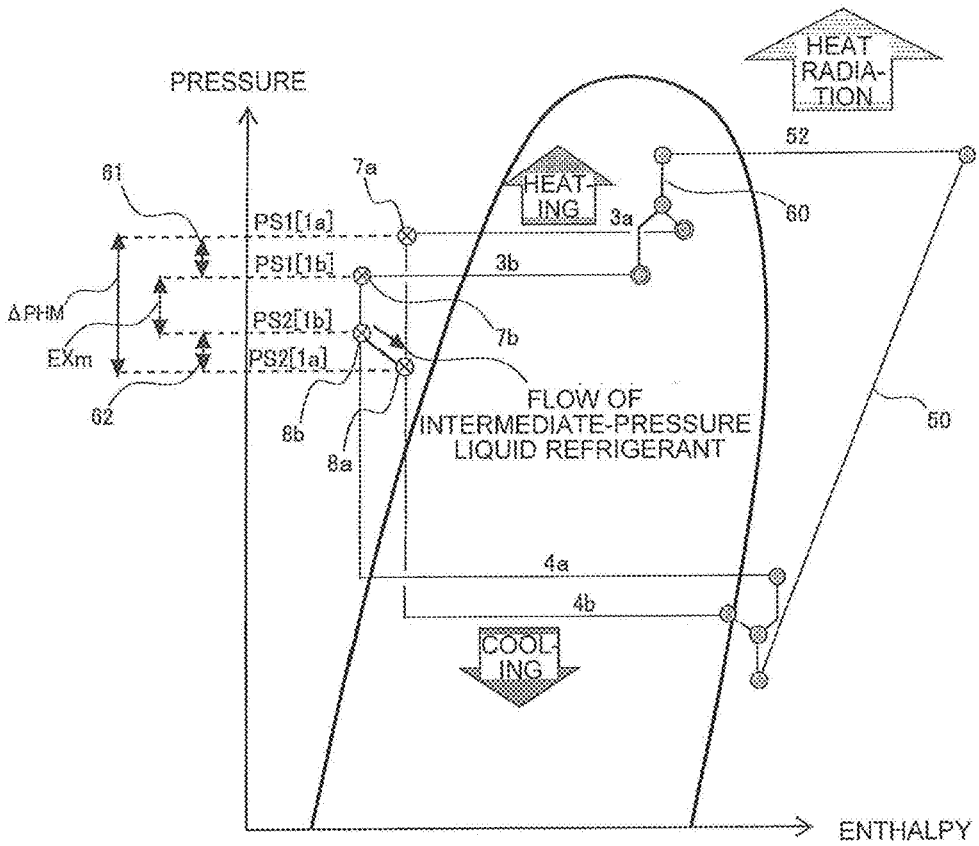
FIG. 5 is a Mollier chart of the refrigeration cycle apparatus according to Embodiment 1 in a cooling main operation mode.

FIG. 5 is a Mollier chart of the refrigeration cycle apparatus according to Embodiment 1 in a cooling main operation mode.

As illustrated in FIGS. 1 and 2, the refrigeration cycle apparatus according to Embodiment 1 is mainly constituted by connecting an outdoor unit 100 to a plurality of branch units (i.e., a first branch unit 1*a* and a second branch unit 1*b*) by a high-pressure refrigerant pipe 2*a*, a low-pressure refrigerant pipe 2*b*, and an intermediate-pressure refrigerant pipe 2*c*.

As illustrated in FIG. 1, as an example of arrangement of components, the second branch unit 1*b* has a refrigerant pipe length larger than that of the first branch unit 1*a* by B [m] with respect to the outdoor unit 100, and is disposed at a location higher than the first branch unit 1*a* by D [m]. A refrigerant pipe length connecting the outdoor unit 100 and the first branch unit 1*a* to each other is A [m], and a height difference between the outdoor unit 100 and the first branch unit 1*a* is C [m].

Configurations of components and operation modes will now be described.

[Outdoor Unit 100]

The outdoor unit 100 serves as a heat source in the refrigeration cycle apparatus, and includes, as base components, a compressor 50 for compressing refrigerant into high-temperature high-pressure refrigerant and transferring the refrigerant into a refrigerant passage, a refrigerant flow switching device 51 such as a four-way valve for switching a flow of refrigerant depending on operation modes of the outdoor unit 100, that is, a heating operation mode and a cooling operation mode, and an outdoor heat exchanger 52 serving as an evaporator in the heating operation mode and a condenser in the cooling operation mode. The outdoor unit 100 preferably includes an accumulator 53 for storing surplus refrigerant generated due to a difference between the heating operation mode and the cooling operation mode or surplus refrigerant responsive to transient change of operation.

The components described above are connected to each other in series by refrigerant pipes. The refrigerant pipes of the outdoor unit 100 are provided with check valves 54*a*, 54*b*, 54*c*, and 54*d* for allowing refrigerant to flow only in one direction. A refrigerant circuit including these check valves is disposed in the outdoor unit 100 so that a flow of refrigerant into the branch units 1*a* and 1*b* can be fixed in one direction, irrespective of the operation mode of the indoor unit 30.

[Branch Units 1*a* and 1*b*]

The first branch unit 1*a* and the second branch unit 1*b* have the same internal structure, and thus, the first branch unit 1*a* will be described as a representative example.

The first branch unit 1*a* includes two or more intermediate heat exchangers (3*a* and 4*a* in this example). The intermediate heat exchangers 3*a* and 4*a* perform heat exchange between refrigerant at a heat source side and a secondary heat medium at a use side, and transfers cooling energy or heating energy of the heat-source side refrigerant generated in the outdoor unit 100 to the secondary heat medium. Thus, the intermediate heat exchangers 3*a* and 4*a* serve as condensers (radiators) in supplying a heating medium to the indoor unit 30 in a heating operation and serve as evaporators in supplying a cooling medium to the indoor unit in a cooling operation.

The intermediate heat exchanger 3*a* is disposed between a first expansion device 7*a* and a first refrigerant flow switching device 5*a*, and is used for cooling the secondary heat medium in a cooling only operation and a cooling and heating mixed operation mode. Thermometers T1*a* and T2*a* for detecting an outlet temperature of refrigerant are disposed at both ends of a refrigerant channel connected to the intermediate heat exchanger 3*a*.

The intermediate heat exchanger 4*a* is disposed between a second expansion device 8*a* and a second refrigerant flow switching device 6*a*, and is used for heating the heat medium in a heating only operation and a cooling and heating mixed operation mode. Thermometers T3*a* and T4*a* for detecting an outlet temperature of refrigerant are disposed at both ends of a refrigerant channel connected to the intermediate heat exchanger 4*a*.

The first expansion device 7*a* and the second expansion device 8*a* preferably have variable opening degrees, such as electronic expansion valves.

For the first refrigerant flow switching device 5*a* and the second refrigerant flow switching device 6*a*, four-way valves may be used, for example, and switch a refrigerant channel in such a manner that the intermediate heat exchangers 3*a* and 4*a* serve as condensers or evaporators depending on the operation mode of the indoor unit 30. The first refrigerant flow switching device 5*a* is disposed downstream of the intermediate heat exchanger 3*a* in a cooling operation, and the second refrigerant flow switching device 6*a* is disposed downstream of the intermediate heat exchanger 4*a* in the cooling operation.

The first refrigerant flow switching device 5*a* and the second refrigerant flow switching device 6*a* are connected to be switchable between the high-pressure refrigerant pipe 2*a* and the low-pressure refrigerant pipe 2*b* connected to the outdoor unit 100.

A refrigerant channel allowing the first refrigerant flow switching device 5*a* and the second refrigerant flow switching device 6*a* to communicate with the high-pressure refrigerant pipe 2*a* will be hereinafter referred to as a branch unit high-pressure channel 20*a*, a refrigerant channel allowing the first refrigerant flow switching device 5*a* and the second refrigerant flow switching device 6*a* to communicate with the low-pressure refrigerant pipe 2*b* will be hereinafter referred to as a branch unit low-pressure channel 20*b*, and a channel allowing the first expansion device 7*a* and the second expansion device 8*a* to communicate with the high-pressure refrigerant pipe 2*a* through the on-off valve 12*a* will be hereinafter referred to as a branch unit intermediate-pressure channel 20*c*.

The branch unit high-pressure channel 20*a* is provided with a high-pressure gauge PS1.

The branch unit low-pressure channel 20*b* and the branch unit intermediate-pressure channel 20*c* are connected to each other by a branch unit bypass channel 20*d* through a third expansion device 9*a*. A differential pressure between the branch unit low-pressure channel 20*b* and the branch unit intermediate-pressure channel 20*c* can be adjusted by controlling an opening degree of the third expansion device 9*a* depending on an operating state. The branch unit intermediate-pressure channel 20*c* is provided with an intermediate-pressure gauge PS2.

The first branch unit 1*a* according to Embodiment 1 and the second branch unit 1*b* having the same internal refrigerant circuit as that of the first branch unit 1*a* are disposed in parallel with respect to the outdoor unit 100.

The branch unit intermediate-pressure channels 20*c* of the branch units 1*a* and 1 *b* that are disposed in parallel are connected to each other by the intermediate-pressure refrigerant pipe 2*c*. Since the branch unit intermediate-pressure channels 20*c* of the branch units 1*a* and 1 *b* are connected to each other by the intermediate-pressure refrigerant pipe 2*c* as described above, excess and shortage of the amount of intermediate-pressure refrigerant can be adjusted between the branch units 1*a* and 1*b*.

Such excess and shortage of the amount of intermediate-pressure refrigerant occurs when a cooling load is unevenly generated in a specific branch unit between the branch units 1*a* and 1*b*.

In the first branch unit 1*a*, a heat medium flow switching device 32 and a heat medium flow switching device 33 of, for example, three-way valves are provided for each of the indoor units 30 to transfer the secondary heat medium to the indoor unit 30. The heat medium flow switching device 32 is disposed on an outlet side of a heat medium channel of the indoor unit 30 in such a manner that one of three ports of the heat medium flow switching device 32 is connected to the intermediate heat exchanger 3*a*, another port is connected to the intermediate heat exchanger 4*a*, and the other port is connected to the heat medium flow control device 34. The heat medium flow switching device 33 is disposed on an inlet side of the heat medium channel of the indoor unit 30 in such a manner that one of three ports of the heat medium flow switching device 33 is connected to the intermediate heat exchanger 3*a*, another port is connected to the intermediate heat exchanger 4*a*, and the other port is connected to the indoor unit 30. The number of the heat medium flow switching devices 32 and 33 is equal to the number of the indoor units 30, and the heat medium flow switching devices 32 and 33 switch a channel of the heat medium flowing in the indoor unit 30 between the intermediate heat exchanger 3*a* and the intermediate heat exchanger 4*a*. The term "switching" herein includes not only complete switching of the channel from one to the other but also partial switching of the channel from one to the other.

The heat medium flow control device 34 detects a temperature of the heat medium flowing into the indoor unit 30 and a temperature of the heat medium flowing out of the indoor unit 30 so that the amount of the heat medium flowing into the indoor unit 30 is adjusted, thereby enabling an optimum amount of the heat medium to be supplied in accordance with an indoor load. In the example illustrated in FIG. 2, the heat medium flow control device 34 is disposed between the indoor unit 30 and the heat medium flow switching device 32, but may be disposed between the indoor unit 30 and the heat medium flow switching device 33. In each of the indoor units 30, when a load from an air-conditioning apparatus is not needed, such as a thermostat OFF or stopping, the heat medium flow control device 34 is fully closed so that a supply of the heat medium to the indoor unit 30 can be stopped.

In the first branch unit 1*a*, heat medium transfer devices 31 (31*a* and 31*b*) associated with the intermediate heat exchangers 3*a* and 4*a* are provided to transfer a heat medium such as water or an antifreeze to the indoor units 30. The heat medium transfer devices 31 are, for example, pumps, and are provided on heat medium pipes connecting each of the intermediate heat exchangers 3*a* and 4*a* to the heat medium flow switching devices 33 to adjust a flow rate of the heat medium in accordance with the degree of a load necessary for the indoor units 30.

As described above, the configuration of Embodiment described above can obtain an optimum cooling operation or heating operation in accordance with the indoor load.

[Operation Mode]

Flows of refrigerant and the secondary heat medium in each operation mode of the refrigeration cycle apparatus according to Embodiment 1 will now be described. The operation modes of the air-conditioning apparatus include a heating only operation mode in which all the indoor units 30 that are being driven perform a heating operation and a cooling only operation mode in which all the indoor units 30 that are being driven perform a cooling operation.

The operation modes also include a cooling main operation mode that is a mixed operation mode in which indoor units perform both a cooling operation and a heating operation and loads of indoor units 30 performing the cooling operation are greater than those of indoor units 30 performing the heating operation, and a heating main operation mode that is a mixed operation mode in which indoor units perform both a cooling operation and a heating operation and loads of indoor units 30 performing the heating operation are greater than those of indoor units 30 performing the cooling operation.

As described above, since the refrigeration cycle apparatus according to Embodiment 1 has four modes of the heating only operation mode, the cooling only operation mode, the cooling main operation mode, and the heating main operation mode, opening and closing control of the control valves in the modes are collectively shown in FIG. 3.

In FIG. 3, SH control designates control of an expansion device using a degree of superheat of heat exchanger outlet refrigerant, and SC control designates control of an expansion device using a degree of subcooling of heat exchanger outlet refrigerant. The terms SHm and SCm respectively designate a target value of the degree of superheat and a target value of the degree of subcooling. A circle (○) designates an opening degree of a fully open state, and an X-mark designates an opening degree of a fully closed state. The term ΔPHMm [kgf/cm$^2$] designates a target differential pressure across an expansion device.

[Heating Only Operation Mode]

A flow of refrigerant in the heating only operation mode will be described with reference to FIG. 2.

Low-temperature low-pressure refrigerant flows into the compressor 50, and is discharged as high-temperature high-pressure gas refrigerant. The discharged high-temperature high-pressure refrigerant flows from the outdoor unit 100 into the high-pressure refrigerant pipe 2*a*. The gas refrigerant that has flowed from the high-pressure refrigerant pipe 2*a* into the branch unit 1*a* is branched off and flows into the first refrigerant flow switching device 5*a* and the second refrigerant flow switching device 6*a*. At this time, the first refrigerant flow switching device 5*a* and the second refrigerant flow switching device 6*a* are switched to a heating operation side. Gas refrigerant that has passed through the first refrigerant flow switching device 5*a* and the second refrigerant flow switching device 6*a* passes through the intermediate heat exchangers 3*a* and 4*a* to, thereby, exchange heat with a secondary heat medium such as water or an antifreeze in the intermediate heat exchangers 3*a* and 4*a*.

The refrigerant that has become high-temperature high-pressure liquid refrigerant after heat exchange with the secondary heat medium expands while passing through the first expansion device 7*a* and the second expansion device 8*a* to become intermediate-pressure liquid refrigerant. At this time, opening degrees of the first expansion device 7*a* and the second expansion device 8*a* are controlled in such a manner that a degree of subcooling that is a temperature difference between an outlet refrigerant temperature of heat exchanger detected by the thermometers T1*a* and T2*a* and a condensing temperature obtained from the high-pressure gauge PS1 to be a predetermined value (e.g., 10 degrees C.).

The intermediate-pressure liquid refrigerant that has passed through the first expansion device 7*a* and the intermediate-pressure liquid refrigerant that has passed through the second expansion device 8*a* are merged and the resulting refrigerant flows into the branch unit low-pressure channel 20*b* through the branch unit bypass channel 20*d*. At this time, the on-off valve 12*a* is controlled to be fully closed, and the opening degree of the third expansion device 9*a* is controlled in such a manner that a pressure difference between a pressure detected by the high-pressure gauge PS1 and a pressure detected by the intermediate-pressure gauge PS2 to be a predetermined value (e.g., about 6.2 kgf/cm$^2$). This control is performed to prepare intermediate-pressure refrigerant for switching from the heating only operation mode to the cooling main operation mode described later.

The intermediate-pressure liquid refrigerant that has flowed into the third expansion device 9*a* becomes low-temperature low-pressure two-phase refrigerant, and is transferred to the outdoor unit 100 through the low-pressure refrigerant pipe 2*b*. The low-temperature low-pressure two-phase refrigerant transferred to the outdoor unit 100 flows into the outdoor heat exchanger 52 and exchanges heat with outdoor air so that the resulting refrigerant becomes low-temperature low-pressure gas refrigerant and returns to the compressor 50.

A flow of the heat medium in the heating only operation mode will now be described. As described above, the heat medium such as water or an antifreeze exchanges heat with high-temperature high-pressure gas refrigerant in the intermediate heat exchangers 3*a* and 4*a* and becomes high-temperature secondary heat medium. The high-temperature secondary heat medium obtained in the intermediate heat exchangers 3*a* and 4*a* is transferred to the indoor unit 30 by the heat medium transfer devices 31*a* and 31*b* respectively connected to the intermediate heat exchangers 3*a* and 4*a*. The transferred secondary heat medium passes through the heat medium flow switching devices (on the inlet side) 33 connected to the indoor units 30, and the heat medium flow control devices 34 adjusts a flow rate of the heat medium flowing into the indoor units 30. At this time, the opening degrees of the heat medium flow switching devices 33 are adjusted to the intermediate opening degree or adjusted in accordance with a heat medium temperature at the outlets of the intermediate heat exchangers 3*a* and 4*a* in order to supply the secondary heat medium transferred from both of the intermediate heat exchangers 3*a* and 4*a* to the heat medium flow control device 34 and the indoor units 30.

The secondary heat medium that has flowed into the indoor units 30 connected by heat medium pipes exchange heat with indoor air in a room, thereby performing a heating operation. The heat medium exchanged heat is transferred into the first branch unit 1*a* through the heat medium pipes and the heat medium flow control devices 34. The transferred heat medium flows into the intermediate heat exchangers 3*a* and 4*a* through the heat medium flow switching devices (on the outlet side) 32, receives a quantity of heat corresponding to the amount supplied to the room from refrigerant through the indoor unit 30, and is transferred to the heat medium transfer devices 31*a* and 31*b* again.

[Cooling Only Operation Mode]

A flow of refrigerant in the cooling only operation mode will be described with reference to FIG. 2.

Low-temperature low-pressure gas refrigerant flows into the compressor 50, and is discharged as high-temperature high-pressure gas refrigerant. The discharged high-temperature high-pressure refrigerant flows into the outdoor heat exchanger 52, and exchanges heat with outdoor air so that the resulting refrigerant becomes high-temperature liquid refrigerant and flows from the outdoor unit 100 into the high-pressure refrigerant pipe 2*a*. The liquid refrigerant that has flowed from the high-pressure refrigerant pipe 2*a* into the branch unit 1*a* flows into the branch unit intermediate-pressure channel 20*c* through the fully-open on-off valve 12*a*. The refrigerant then expands while passing through the first expansion device 7*a* and the second expansion device 8*a*, becomes low-pressure two-phase refrigerant, exchanges heat with a secondary heat medium such as water or an antifreeze while passing through the intermediate heat exchangers 3*a* and 4*a*, and evaporates to become gas refrigerant. At this time, the opening degrees of the first expansion device 7*a* and the second expansion device 8*a* are controlled in such a manner that a degree of superheat that is a temperature difference between an outlet refrigerant temperature of the heat exchanger detected by the thermometers T2*a* and T4*a* and an evaporating temperature to be a predetermined value (e.g., 2 degrees C.). The third expansion device 9*a* is controlled to be fully closed.

Thereafter, the gas refrigerant flows into the first refrigerant flow switching device 5*a* and the second refrigerant flow switching device 6*a*. At this time, the first refrigerant flow switching device 5*a* and the second refrigerant flow switching device 6*a* are switched to a cooling operation side. Gas refrigerant that has passed through the first refrigerant flow switching device 5*a* and the second refrigerant flow switching device 6*a* flows into the branch unit low-pressure channel 20*b*, is transferred to the outdoor unit 100 through the low-pressure refrigerant pipe 2*b*, and returns to the compressor.

A flow of the heat medium in the cooling only operation mode will now be described. As described above, the secondary heat medium such as water or an antifreeze is reduced in temperature in the intermediate heat exchangers 3*a* and 4*a*, and is transferred to the indoor units 30 by the heat medium transfer devices 31*a* and 31 *b* respectively connected to the intermediate heat exchangers 3*a* and 4*a*. The transferred secondary heat medium passes through the heat medium flow switching device (on the inlet side) 33 connected to the indoor units 30, and a flow rate of the heat medium flowing into the indoor units 30 is adjusted by the heat medium flow control device 34. At this time, the opening degree of the heat medium flow switching device 33 is adjusted to an intermediate opening degree or adjusted in accordance with a heat medium temperature at the outlets of the intermediate heat exchangers 3*a* and 4*a* in order to supply the secondary heat medium transferred from both of the intermediate heat exchangers 3*a* and 4*a* to the heat medium flow control devices 34 and the indoor units 30.

The secondary heat medium that has flowed into the indoor units 30 connected by the heat medium pipes exchanges heat with indoor air in the room, thereby performing a cooling operation. The secondary heat medium subjected to heat exchange is transferred into the branch unit 1*a* through the heat medium pipes and the heat medium flow control device 34. The transferred secondary heat medium flows into the intermediate heat exchangers 3*a* and 4*a* through the heat medium flow switching devices (on the outlet side) 32, a quantity of heat received from air in the room through the indoor units 30 is transferred to refrigerant so that the temperature of the secondary heat medium decreases, and the resulting secondary heat medium is transferred with the heat medium transfer devices 31*a* and 31*b* again.

[Cooling Main Operation Mode]

FIG. 4 illustrates a flow of refrigerant in a cooling main operation mode of the refrigeration cycle apparatus according to Embodiment 1.

A flow of refrigerant in a cooling main mode will be described with reference to FIG. 4.

Low-temperature low-pressure refrigerant flows into the compressor 50, and is discharged as high-temperature high-pressure gas refrigerant. The discharged high-temperature high-pressure refrigerant passes through the refrigerant flow switching device 51 of the outdoor unit 100, a part of the refrigerant except a part of the refrigerant having a thermal capacity necessary for indoor units 30 in a heating operation mode among all the indoor units 30 releases heat by the outdoor heat exchanger 52, and becomes high-temperature high-pressure gas or two-phase gas-liquid refrigerant.

The refrigerant flow switching device 51 is switched in such a manner that high-temperature high-pressure gas refrigerant discharged from the compressor 50 passes through the outdoor heat exchanger 52.

The high-temperature high-pressure gas or two-phase refrigerant flows into the branch unit 1*a* through the high-pressure refrigerant pipe 2*a*. At this time, the on-off valve 12*a* is fully closed.

Between the refrigerant flow switching devices 5*a* and 6*a* in the branch unit 1*a*, the first refrigerant flow switching device 5*a* is switched to a heating operation side, and the second refrigerant flow switching device 6*a* is switched to a cooling operation side.

The refrigerant that has passed through the first refrigerant flow switching device 5*a* flows into the intermediate heat exchanger 3*a*. High-temperature high-pressure gas or two-phase refrigerant that has flowed into the intermediate heat exchanger 3*a* supplies a quantity of heat to the secondary heat medium such as water or an antifreeze that has also flowed into the intermediate heat exchanger 3*a*, and becomes high-temperature high-pressure liquid. The high-temperature high-pressure liquid refrigerant expands while passing through the first expansion device 7*a*, and becomes intermediate-pressure liquid refrigerant. At this time, the first expansion device 7*a* is controlled in such a manner that a temperature of outlet refrigerant of the intermediate heat exchanger 3*a* is detected by the thermometer T1*a* and a degree of subcooling thereof to be a target value (e.g., 10 degrees C.).

The refrigerant that has become intermediate-pressure liquid refrigerant passes through the second expansion device 8*a* to become low-temperature low-pressure refrigerant, and flows into the intermediate heat exchanger 4*a*. The refrigerant evaporates by receiving a quantity of heat from the secondary heat medium such as water or an antifreeze that has also flowed into the intermediate heat exchanger 4*a*, and becomes low-temperature low-pressure gas refrigerant. At this time, the second expansion device 8*a* through which the refrigerant passes is controlled in such a manner that a temperature of refrigerant that has passed through the intermediate heat exchanger 4*a* and exchanged heat is detected by the thermometer T4*a* and a degree of superheat thereof to be a target value (e.g., 2 degrees C.). The third expansion device 9*a* is fully closed.

The low-temperature low-pressure gas refrigerant passes through the second refrigerant flow switching device 6*a*, then passes through the low-pressure refrigerant pipe 2*b*, is transferred to the outdoor unit 100, and returns to the compressor 50.

[Mollier Chart in Cooling Main Operation Mode]

FIG. 5 shows a Mollier chart of the refrigeration cycle apparatus according to Embodiment 1 in the cooling main operation mode.

The Mollier chart of FIG. 5 shows an example in which intermediate-pressure refrigerant is distributed by using the intermediate-pressure refrigerant pipe 2*c* to adjust excess and shortage of a cooling load between the first branch unit 1*a* and the second branch unit 1*b*. In this example, a cooling load of the first branch unit 1*a* is larger than that of the second branch unit 1*b*, and intermediate-pressure refrigerant is supplied from the second branch unit 1*b* to the first branch unit 1*a* where intermediate-pressure refrigerant is in short. As a flow of refrigerant at this time, intermediate-pressure liquid refrigerant is distributed in the intermediate-pressure refrigerant pipe 2*c* from the second branch unit 1*b* to the first branch unit 1*a*, as illustrated in FIG. 4.

In this example, a pressure loss of refrigerant caused by the refrigerant pipes of the refrigeration cycle apparatus according to Embodiment 1 illustrated in FIG. 1 is taken into consideration.

That is, the Mollier chart shows a pressure loss in which pipe lengths and height differences among pipes in arrangement of the outdoor unit 100, the first branch unit 1*a*, and the second branch unit 1*b* illustrated in FIG. 1 are taken into consideration.

The pipe pressure loss defined in Embodiment 1 refers to a pressure loss of a sum of a pressure loss $\Delta Pp$ occurring when refrigerant flows in a pipe, a pressure difference (head difference) $\Delta Ph$ caused by a height difference among pipes (liquid heads), and a pressure loss ΔPlev occurring when refrigerant flows with a fully-opened expansion device at a heating operation side.

As described above, in the refrigeration cycle apparatus according to Embodiment 1, the second branch unit 1*b* has a refrigerant pipe length larger than that of the first branch unit 1*a* by B [m] with respect to the outdoor unit 100, and is disposed at a location higher than the first branch unit 1*a* by D [m]. A refrigerant pipe length connecting the outdoor unit 100 and the first branch unit 1*a* to each other is A [m], and a height difference between the outdoor unit 100 and the first branch unit 1*a* is C [m].

A change of state of refrigerant in the refrigeration cycle apparatus according to Embodiment 1 will be described with reference to the Mollier chart of FIG. 5.

Gas refrigerant that has been compressed to become high-temperature high-pressure refrigerant in the compressor 50 partially rejects heat to the air at a condensing temperature Tc in the outdoor heat exchanger 52. Then, the refrigerant is subjected to a pipe pressure loss downward along a Y axis (pressure axis) on the Mollier chart of FIG. 5 in the high-pressure refrigerant pipe 2*a* (with a length of A [m] and a height difference of C [m]) between the compressor 50 and the first branch unit 1*a* to have its pressure reduced (corresponding to a first pressure drop portion 60), and branches off into the first branch unit 1*a* and the second branch unit 1*b*. The refrigerant flowing toward the second branch unit 1*b* is also subjected to a pipe pressure loss in the high-pressure refrigerant pipe 2*a* (with a length of B [m] and a height difference of D [m]) between the first branch unit 1*a* and the second branch unit 1*b* to have its pressure reduced (corresponding to a second pressure drop portion 61) downward along the Y axis on the Mollier chart. In this pressure state, the high-pressure gauge PS1 [1*a*] in the first branch unit 1*a* and the high-pressure gauge PS1 [1*b*] in the second branch unit 1*b* detect condensing pressures.

High-pressure refrigerant that has flowed into the intermediate heat exchangers 3*a* and 3*b* serving as condensers in the first branch unit 1*a* and the second branch unit 1*b* respectively heats the secondary heat medium to be condensed, and moves to the left across a saturated liquid line on the Mollier chart to be subcooled.

As shown in the Mollier chart, the condensing temperature of the intermediate heat exchanger 3*b* of the second branch unit 1*b* is lower than that of the intermediate heat exchanger 3*a* of the first branch unit 1*a* by a degree corresponding to a pipe pressure loss of refrigerant (indicated by the second pressure drop portion 61).

State points of outlet refrigerant of the intermediate heat exchangers 3*a* and 3*b* are indicated by points 7*a* and 7*b* (refrigerant inlet locations of the expansion devices 7*a* and 7*b*). As described above, degrees of subcooling of the intermediate heat exchangers 3*a* and 3*b* are adjusted by the first expansion devices 7*a* and 7*b*. Then, the refrigerant becomes intermediate-pressure refrigerant and flows into the branch unit intermediate-pressure channel 20*c*. The intermediate-pressure refrigerant in the first branch unit 1*a* and the second branch unit 1*b* expands in the second expansion devices 8*a* and 8*b* to become low-temperature low-pressure two-phase refrigerant.

The pressure of the intermediate-pressure refrigerant is adjusted in the expansion devices 8*a* and 8*b*. In this example, since a cooling load of the first branch unit 1*a* is relatively large, the second expansion device 8*a* associated with the intermediate heat exchanger 4*a* serving as an evaporator in the first branch unit 1*a* needs to be adjusted in such a manner that the pressure of intermediate-pressure refrigerant in the first branch unit 1*a* detected by the intermediate-pressure gauge PS2 [1*a*] is smaller than the pressure of intermediate-pressure refrigerant in the second branch unit 1*b* detected by the intermediate-pressure gauge PS2 [1*b*], in order to supply intermediate-pressure refrigerant from the second branch unit 1*b* to the first branch unit 1*a*.

The second expansion device 8*a* is adjusted in the manner described above so that the pressure of intermediate-pressure liquid refrigerant in the first branch unit 1*a* is lower than that of intermediate-pressure liquid refrigerant in the second branch unit 1*b* as shown in FIG. 5, and intermediate-pressure liquid refrigerant is supplied from the second branch unit 1*b* to the first branch unit 1*a* through the intermediate-pressure refrigerant pipe 2*c*.

The refrigerant evaporates and becomes low-pressure gas refrigerant in the intermediate heat exchangers 4*a* and 4*b* serving as evaporators, thereby cooling the secondary heat medium. Thereafter, the pressure of refrigerant is further reduced and the refrigerant is sucked into the compressor 50 with a pipe pressure loss caused by the low-pressure refrigerant pipe 2*b*.

A differential pressure for control in the first expansion device 7*b* of the intermediate heat exchanger 3*b* for heating in a case where the second branch unit 1*b* has a heating load in the refrigeration cycle apparatus described above will be described.

In general, to control a flow rate of fluid, an expansion device is selected with a minimum control differential pressure being obtained across fluid to pass therethrough.

In a case where the second branch unit 1*b* has a heating load in adjusting the second expansion device 8*a* to have a pressure detected by the intermediate-pressure gauge PS2 [1*a*] of the first branch unit 1*a* smaller than a pressure detected by the intermediate-pressure gauge PS2 [1*b*] of the second branch unit 1*b*, a flow rate of the high-temperature gas refrigerant is controlled by the first expansion device 7*b* of the intermediate heat exchanger 3*b* for heating, and thus, a minimum control differential pressure EXm (e.g., 1.5 [kgf/cm$^2$]) needs to be obtained in the first expansion device 7*b*.

Thus, a differential pressure between the point 7*b* (a condensing pressure at the inlet of the first expansion device 7*b*) and the point 8*b* (an intermediate refrigerant pressure at the inlet of the second expansion device 8*b*) on the Mollier chart of FIG. 5 needs to be obtained as a minimum control differential pressure EXm of the first expansion device 7*b*. That is, a differential pressure between the pressure detected by the high-pressure gauge PS1 [1*b*] and the pressure detected by the intermediate-pressure gauge PS2 [1*b*] needs to be obtained as a minimum control differential pressure EXm.

To obtain this pressure, in controlling the second expansion device 8*a*, the minimum control differential pressure EXm of the first expansion device 7*b* needs to be obtained in consideration of the second pressure drop portion 61 that is a pipe pressure loss in the high-pressure refrigerant pipe 2*a* between the first branch unit 1*a* and the second branch unit 1*b* and a third pressure drop portion 62 for allowing intermediate-pressure liquid refrigerant to flow from the second branch unit 1*b* to the first branch unit 1*a* through the intermediate-pressure refrigerant pipe 2*c*.

The second pressure drop portion 61 is assumed to be a pipe pressure loss occurring in a case where gas refrigerant for a maximum heating load generated in the second branch unit flows in the high-pressure refrigerant pipe 2*a*.

Thus, the differential pressure between the high-pressure gauge PS1 [1*a*] and the intermediate-pressure gauge PS2

[1*a*] needs to be greater than or equal to a sum (differential pressure ΔPHM) of a differential pressure (minimum control differential pressure EXm) between the high-pressure gauge PS1 [1*b*] and the intermediate-pressure gauge PS2 [1*b*], a differential pressure (second pressure drop portion 61) between the high-pressure gauge PS1 [1*a*] and the high-pressure gauge PS1 [1*b*], and a differential pressure (third pressure drop portion 62) between the intermediate-pressure gauge PS2 [1*b*] and the intermediate-pressure gauge PS2 [1*a*]. For this reason, the second expansion device 8*a* associated with the intermediate heat exchanger 4*a* serving as an evaporator in the first branch unit 1*a* is controlled to cause the differential pressure between the high-pressure gauge PS1 [1*a*] and the intermediate-pressure gauge PS2 [1*a*] to be greater than or equal to a set value (differential pressure ΔPHM).

In other words, the second expansion device 8*a* associated with the intermediate heat exchanger 4*a* serving as an evaporator in the first branch unit 1*a* having a small pipe pressure loss from the outdoor unit 100 is controlled in such a manner that a differential pressure between a refrigerant pressure detected by the high-pressure gauge PS1 [1*a*] of the first branch unit 1*a* having a small pipe pressure loss from the outdoor unit 100 and a refrigerant pressure detected by the intermediate-pressure gauge PS2 [1*a*] is greater than or equal to the set value (differential pressure ΔPHM) in which the minimum control differential pressure EXm of the first expansion device 7*b* associated with the intermediate heat exchanger 3*b* serving as a condenser in the second branch unit 1*b* having a large pipe pressure loss from the outdoor unit 100 is taken into consideration.

The opening degree of the second expansion device 8*a* is controlled in the manner described above so that high-pressure gas refrigerant can be supplied to the intermediate heat exchanger 3*b* serving as a condenser in the second branch unit 1*b* having a larger pipe pressure loss from the outdoor unit 100 than that of the first branch unit 1*a* and the minimum control differential pressure EXm of the first expansion device 7*b* can be obtained.

In the above example, both of the first branch unit 1*a* and the second branch unit 1*b* are in the cooling main operation mode. However, in a case where the first branch unit 1*a* has at least a cooling load and the second branch unit 1*b* has at least a heating load, control for obtaining the minimum control differential pressure EXm of the first expansion device 7*b* is needed.

In the above example, two branch units are provided. However, control in which three or more branch units may be connected to in parallel to the outdoor unit 100 so that the minimum control differential pressure EXm is obtained for branch units having the maximum pipe pressure loss and the minimum pipe pressure loss from the outdoor unit 100. In this case, the expansion device associated with the intermediate heat exchanger serving as an evaporator in a branch unit having a minimum pipe pressure loss from the outdoor unit 100 is controlled in such a manner that a differential pressure between a refrigerant pressure detected by the high-pressure gauge PS1 of the branch unit having the minimum pipe pressure loss from the outdoor unit 100 and the refrigerant pressure detected by the intermediate-pressure gauge PS2 is greater than or equal to a set value (differential pressure ΔPHM) in which the minimum control differential pressure EXm of the expansion device associated with the intermediate heat exchanger serving as a condenser in the branch unit having the maximum pipe pressure loss from the outdoor unit 100 is taken into consideration.

In this manner, the expansion device associated with the intermediate heat exchanger serving as an evaporator in the branch unit having the minimum pipe pressure loss is controlled so that high-pressure gas refrigerant can be supplied to a condenser in the branch unit having the maximum pipe pressure loss and a minimum control pressure of an expansion device associated with the condenser can be obtained.

In a case where the second branch unit 1*b* having a large pipe pressure loss has a large cooling load and intermediate-pressure liquid refrigerant is intended to be supplied from the first branch unit 1*a* to the second branch unit 1*b*, a gradient from PS2 [1*b*] to PS2 [1*a*] on the Mollier chart of FIG. 5 changes to the opposite direction, that is, becomes left-downward, and the minimum control differential pressure EXm increases, and thus, a control pressure shifts to a safe side. Thus, in consideration of a load state in which the first branch unit 1*a* having a small pipe pressure loss has a large cooling load and intermediate-pressure liquid refrigerant is supplied from the second branch unit 1*b* to the first branch unit 1*a* as described above, a shortage of a control pressure of an expansion device can be avoided.

A flow of the secondary heat medium in the cooling main operation mode will now be described. As described above, the secondary heat medium whose temperature has been reduced in the intermediate heat exchanger 4*a* is transferred by the heat medium transfer device 31*a* connected to the intermediate heat exchanger 4*a*, and the secondary heat medium whose temperature has been increased in the intermediate heat exchanger 3*a* is transferred by the heat medium transfer device 31*b* connected to the intermediate heat exchanger 3*a*. The transferred secondary heat medium passes through the heat medium flow switching devices (on the inlet side) 33 connected to the indoor units 30, and the heat medium flow control devices 34 adjust flow rates of the heat medium to flow into the indoor units 30. At this time, in a case where the indoor units 30 connected to the heat medium flow switching devices 33 are in the heating operation mode, the heat medium flow switching devices 33 are switched to a direction to which the intermediate heat exchanger 3*a* and the heat medium transfer device 31*b* are connected, whereas in a case where the indoor units 30 connected to the heat medium flow switching devices 33 are in the cooling operation mode, the heat medium flow switching devices 33 are switched to a direction to which the intermediate heat exchanger 4*a* and the heat medium transfer device 31*a* are connected.

That is, the secondary heat medium to be supplied to indoor units 30 can be switched to hot water or cold water depending on the operation mode of the indoor units 30. The secondary heat medium that has flowed into the indoor units 30 connected by the heat medium pipes exchanges heat with indoor air in the room, thereby performing a heating operation or a cooling operation. The secondary heat medium that has exchanged heat is transferred into the branch unit 1*a* through the heat medium pipes and the heat medium flow control devices 34. The transferred secondary heat medium flows into the heat medium flow switching devices (on the outlet side) 32. In a case where the indoor units 30 connected to the heat medium flow switching devices 32 are in the heating operation mode, the heat medium flow switching devices 32 are switched to a direction to which the intermediate heat exchanger 3*a* is connected, whereas in a case where the indoor units 30 connected to the heat medium flow switching devices 32 are in the cooling operation mode, the heat medium flow switching devices 32 are switched to a direction to which the intermediate heat exchanger 4*a* is connected. In this manner, the secondary heat medium used in the heating operation mode can appropriately flow into the intermediate heat exchanger 3*a* that receives heat from refrigerant for heating, and the secondary heat medium used in the cooling operation mode can appropriately flow into the intermediate heat exchanger 4*a* that receives heat from refrigerant for cooling. Then the flows of the respective secondary heat medium exchange heat with refrigerant, and then are transferred to the heat medium transfer devices 31*a* and 31 *b*.

[Heating Main Operation Mode]

A flow of refrigerant in a heating main operation mode will be described with reference to FIG. 2.

Low-temperature low-pressure refrigerant flows into the compressor 50, and is discharged as high-temperature high-pressure gas refrigerant. The discharged high-temperature high-pressure refrigerant flows from the outdoor unit 100 into the high-pressure refrigerant pipe 2*a*. The refrigerant flow switching device 51 is switched in such a manner that high-temperature high-pressure gas refrigerant discharged from the compressor 50 is transferred to the outside of the outdoor unit 100 without passing through the outdoor heat exchanger 52. Gas refrigerant flows into the first branch unit 1*a* through the high-pressure refrigerant pipe 2*a*. Between the refrigerant flow switching devices 5*a* and 6*a* in the first branch unit 1*a*, the first refrigerant flow switching device 5*a* is switched to a heating operation side, and the second refrigerant flow switching device 6*a* is switched to a cooling operation side. The high-temperature high-pressure gas refrigerant that has flowed into the first branch unit 1*a* and passed through the first refrigerant flow switching device 5*a* flows into the intermediate heat exchanger 3*a*, supplies a quantity of heat to the secondary heat medium, such as water or an antifreeze, that has also flowed into the intermediate heat exchanger 3*a*, and is condensed to become high-temperature high-pressure liquid.

The refrigerant that has become high-temperature high-pressure liquid expands while passing through the first expansion device 7*a*, and becomes intermediate-pressure liquid refrigerant. At this time, the first expansion device 7*a* is controlled in such a manner that the degree of subcooling obtained by detecting a temperature of outlet refrigerant of the intermediate heat exchanger 3*a* with the thermometer T1*a* is a target value (e.g., 10 degrees C.). The refrigerant that has become intermediate-pressure liquid refrigerant passes through the second expansion device 8*a* to become low-temperature low-pressure refrigerant, and flows into the intermediate heat exchanger 3*a*. The refrigerant receives a quantity of heat from the secondary heat medium, such as water or an antifreeze, that has also flowed into the intermediate heat exchanger 3*a*, and evaporates. At this time, the second expansion device 8*a* through which the refrigerant passes is controlled in such a manner that a temperature of refrigerant that has passed through the intermediate heat exchanger 4*a* is detected with the thermometer T4*a* and a degree of superheat thereof is a target value (e.g., 2 degrees C.).

Then, refrigerant that has passed through the second refrigerant flow switching device 6*a* is transferred to the outdoor unit 100 through the low-pressure refrigerant pipe 2*b*. At this time, an opening degree of the third expansion device 9*a* is controlled in such a manner that a pressure difference between a pressure detected by the high-pressure gauge PS1 and a pressure detected by the intermediate-pressure gauge PS2 is a predetermined value (e.g., about 6.2 kgf/cm$^2$). This control is performed to prepare intermediate-pressure refrigerant to be used in switching from the heating only operation mode to a cooling main operation mode described later. Then, low-temperature low-pressure two-phase refrigerant transferred to the outdoor unit 100 exchanges heat with outdoor air while passing through the outdoor heat exchanger 52, evaporates to become low-temperature low-pressure gas refrigerant, and then returns to the compressor 50.

A flow of the secondary heat medium in the heating main operation mode will now be described. As described above, the secondary heat medium whose temperature has been reduced in the intermediate heat exchanger 4*a* is transferred by the heat medium transfer device 31*a* connected to the intermediate heat exchanger 4*a*, and the secondary heat medium whose temperature has been increased in the intermediate heat exchanger 3*a* is transferred by the heat medium transfer device 31*b* connected to the intermediate heat exchanger 3*a*. The transferred secondary heat medium passes through the heat medium flow switching devices (on the inlet side) 33 connected to the indoor units 30, and flow rates of the heat medium to flow into the indoor units 30 are adjusted by the heat medium flow control devices 34. At this time, in a case where the indoor units 30 connected to the heat medium flow switching devices 33 are in the heating operation mode, the heat medium flow switching devices 33 are switched to a direction to which the intermediate heat exchanger 3*a* and the heat medium transfer device 31*b* are connected, whereas in a case where the indoor units 30 connected to the heat medium flow switching devices 33 are in the cooling operation mode, the heat medium flow switching devices 33 are switched to a direction to which the intermediate heat exchanger 4*a* and the heat medium transfer device 31*a* are connected.

That is, the secondary heat medium to be supplied to the indoor unit 30 can be switched to hot water or cold water depending on the operation mode of the indoor unit 30. The secondary heat medium that has flowed into the indoor units 30 connected by the heat medium pipes exchanges heat with indoor air in the room, thereby performing a heating operation or a cooling operation. The secondary heat medium that has exchanged heat is transferred into the branch unit 1*a* through the heat medium pipe and the heat medium flow control device 34.

The transferred secondary heat medium flows into the heat medium flow switching devices (on the outlet side) 32. In a case where the indoor units 30 connected to the heat medium flow switching devices 32 are in the heating operation mode, the heat medium flow switching devices 32 are switched to a direction to which the intermediate heat exchanger 3*a* is connected, whereas in a case where the indoor units 30 connected to the heat medium flow switching devices 32 are in the cooling operation mode, the heat medium flow switching devices 32 are switched to a direction connected to the intermediate heat exchanger 4*a*. In this manner, the secondary heat medium used in the heating operation mode can appropriately flow into the intermediate heat exchanger 3*a* that receives heat from refrigerant for heating, and the secondary heat medium used in the cooling operation mode can appropriately flow into the intermediate heat exchanger 4*a* that receives heat from refrigerant for cooling. Then, the flows of the respective secondary heat medium exchange heat with refrigerant, and then are transferred to the heat medium transfer devices 31*a* and 31*b*.

As described above, a plurality of branch units are connected in parallel to the outdoor unit 100 so that a large number of indoor units 30 can be connected to selectively perform cooling and heating operations, the configuration of refrigerant pipes and crossover wiring for control can be simplified as compared to a conventional configuration in which a main branch unit and sub-branch units are serially connected to an outdoor unit 100, and the amount of enclosed refrigerant can be reduced.

Embodiment 2

Figure 6:
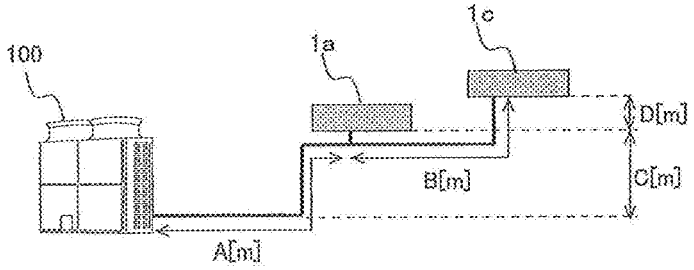
FIG. 6 illustrates an arrangement of branch units of a refrigeration cycle apparatus according to Embodiment 2.

FIG. 6 illustrates an arrangement of branch units of a refrigeration cycle apparatus according to Embodiment 2.

Figure 7:
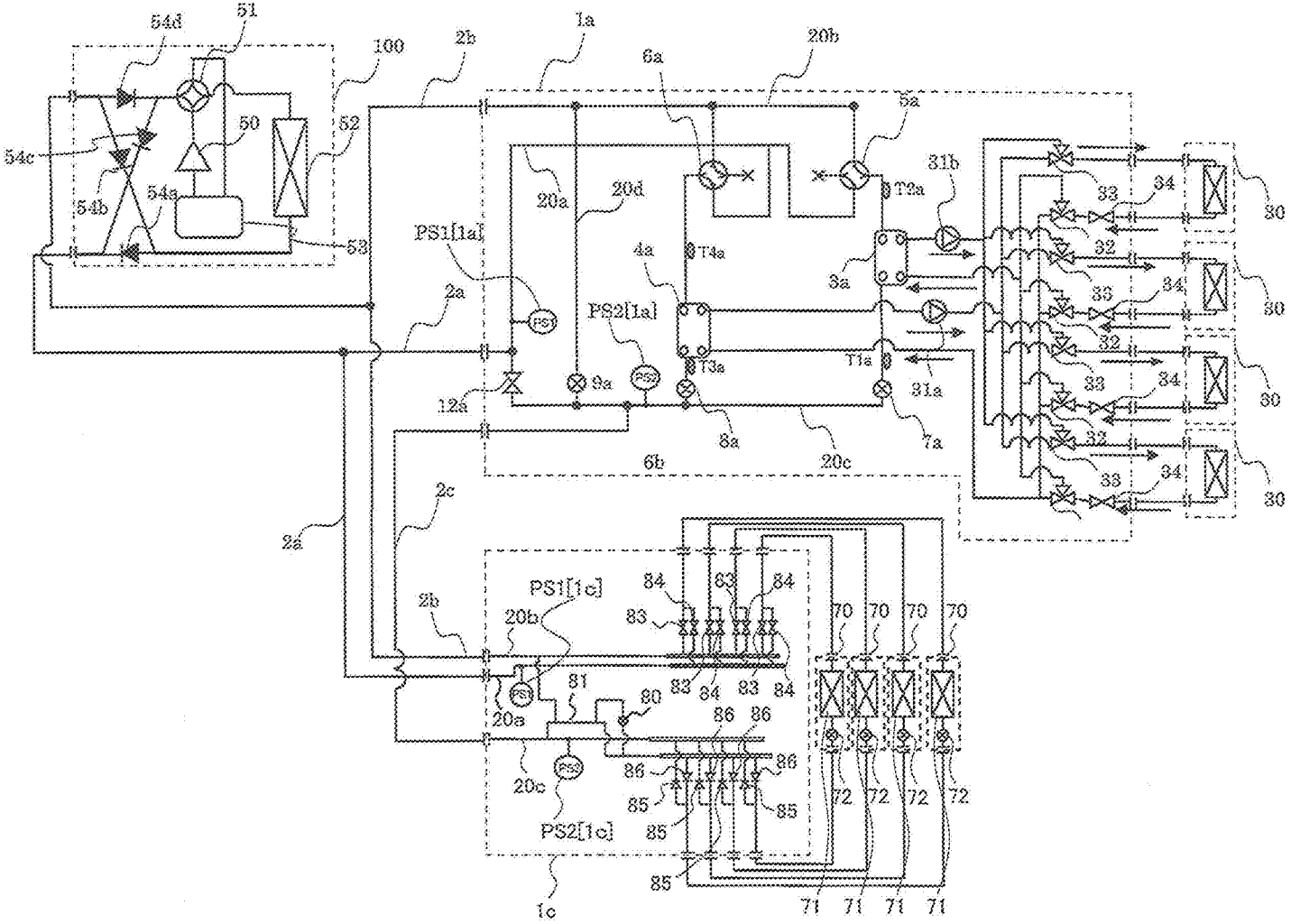
FIG. 7 is a refrigerant circuit diagram of the refrigeration cycle apparatus according to Embodiment 2.

FIG. 7 is a refrigerant circuit diagram of the refrigeration cycle apparatus according to Embodiment 2.

FIG. 8 is a table showing opening and closing control of control valves in operation modes of the refrigeration cycle apparatus according to Embodiment 2.

FIG. 9 is a Mollier chart of the refrigeration cycle apparatus according to Embodiment 2 in a cooling main operation mode.

A configuration and control of the refrigeration cycle apparatus according to Embodiment 2 are basically the same as those of the refrigeration cycle apparatus according to Embodiment 1, and only different aspects thereof will be described.

In Embodiment 1, the branch units 1*a* and 1*b* having the same configuration are connected in parallel to the outdoor unit 100. On the other hand, Embodiment 2 is different from Embodiment 1 in additionally including a direct expansion third branch unit 1*c* for directly supplying refrigerant to the first branch unit 1*a* and the indoor unit 30 of Embodiment 1.

[Branch Unit 1*c*]

As illustrated in FIG. 7, the third branch unit 1*c* includes an expansion device 80, a subcooling heat exchanger 81, on-off valves 83 each disposed at a side toward a branch unit low-pressure channel 20*b*, on-off valves 84 each disposed at a side toward a branch unit high-pressure channel 20*a*, check valves 85 disposed at a side into which refrigerant flowing back from an associated one of refrigerant indoor units 70 toward a branch unit intermediate-pressure channel 20*c* flows, and check valves 86 into which refrigerant flowing from the branch unit intermediate-pressure channel 20*c* toward the refrigerant indoor unit 70 flows.

Thus, the third branch unit 1*c* is connected to the refrigerant indoor units 70 by refrigerant pipes through the check valves 85, the check valves 86, the on-off valves 83, and the on-off valves 84. The on-off valves 83 and the on-off valves 84 are first flow switching devices in the present invention. The check valves 85 and the check valves 86 are second flow switching devices in the present invention.

The expansion device 80 reduces a pressure of part of intermediate-pressure liquid refrigerant that has flowed through the branch unit intermediate-pressure channel 20*c* and has been branched off. The subcooling heat exchanger 81 performs heat exchange between intermediate-pressure liquid refrigerant flowing in the branch unit intermediate-pressure channel 20*c* and liquid refrigerant whose pressure has been reduced in the expansion device 80. That is, the refrigerant whose pressure has been reduced in the expansion device 80 is sent to the subcooling heat exchanger 81 so that a degree of subcooling of intermediate-pressure liquid refrigerant to be supplied to the refrigerant indoor units 70 is obtained.

Opening and closing of the on-off valves 83 and the on-off valves 84 are selectively controlled so that heat source side refrigerant from the outdoor unit 100 is allowed to flow threrethrough or not.

The check valves 85 allow only refrigerant that has returned from the refrigerant indoor units 70 to flow threrethrough. The check valves 86 allow only refrigerant flowing toward the refrigerant indoor units 70 to flow threrethrough.

[Operation Mode]

In a manner similar to Embodiment 1, the third branch unit 1*c* is also switchable among four modes of a heating only operation mode, a cooling only operation mode, a cooling main operation mode, and a heating main operation mode, in response to a request of the refrigerant indoor units 70. Flows of refrigerant in the operation modes will be described.

FIG. 8 is a table showing opening and closing control of control valves in the operation modes of the refrigeration cycle apparatus according to Embodiment 2.

As described above, since the refrigeration cycle apparatus according to Embodiment 2 has four modes of the heating only operation mode, the cooling only operation mode, the cooling main operation mode, and the heating main operation mode, opening and closing control of the control valves in the modes are collectively shown in FIG. 8.

In FIG. 8, SH control designates control of an expansion device using a degree of superheat of heat exchanger outlet refrigerant, and SC control designates control of an expansion device using a degree of subcooling of heat exchanger outlet refrigerant. The terms SHm and SCm respectively designate a target value of the degree of superheat and a target value of the degree of subcooling. A circle (○) designates an opening degree of a fully open state, and an X-mark designates an opening degree of a fully closed state. The term ΔPHMm [kgf/cm$^{2]}$ designates a target differential pressure across an expansion device.

[Heating Only Operation Mode]

A flow of refrigerant in the heating only operation mode will be described with reference to FIG. 7.

High-temperature gas refrigerant passing through the high-pressure refrigerant pipe 2*a* flows into the third branch unit 1*c*. The high-pressure gas refrigerant that has flowed into the third branch unit 1*c* flows into the indoor unit heat exchanger 71 through the on-off valves 84. The high-pressure gas refrigerant that has flowed into the indoor unit heat exchangers 71 has its pressure reduced in the indoor unit expansion devices 72 and becomes intermediate-pressure liquid refrigerant while heating ambient air, passes through the check valves 85 and has its pressure further reduced in the expansion device 80 to become low-pressure two-phase gas-liquid refrigerant. The resulting refrigerant flows out of the third branch unit 1*c* and returns to the outdoor unit 100 through the low-pressure refrigerant pipe 2*b*.

[Cooling Only Operation Mode]

A flow of refrigerant in the cooling only operation mode will be described with reference to FIG. 7.

High-pressure liquid refrigerant passing through the high-pressure refrigerant pipe 2*a* flows into the third branch unit 1*c*. The high-pressure liquid refrigerant that has flowed into the third branch unit 1*c* passes through the check valves 86, has its pressure reduced in the indoor unit expansion devices 72, and becomes low-pressure two-phase gas-liquid refrigerant. The low-pressure two-phase gas-liquid refrigerant flows into the indoor unit heat exchanger 71, absorbs heat therein (cools ambient air) to evaporate, and becomes low-pressure gas refrigerant. The low-pressure gas refrigerant passes through the on-off valves 83 and then the low-pressure refrigerant pipe 2*b* and returns to the outdoor unit 100.

[Cooling Main Operation Mode and Heating Main Operation Mode]

Flows of refrigerant in the cooling main operation mode and the heating main operation mode will be described with reference to FIG. 7.

To the refrigerant indoor units 70 that perform a cooling operation, intermediate-pressure liquid refrigerant is supplied to the indoor unit heat exchangers 71 from the branch unit intermediate-pressure channel 20*c* through the check valves 86. The liquid refrigerant has its pressure reduced in the indoor unit expansion devices 72, evaporates in the indoor unit heat exchangers 71 to become low-pressure gas refrigerant, flows into the branch unit low-pressure channel 20*b* through the on-off valves 83, and returns to the outdoor unit 100 through the low-pressure refrigerant pipe 2*b*.

To the refrigerant indoor unit 70 that perform a heating operation, high-temperature gas refrigerant is supplied from the branch unit high-pressure channel 20*a* to the indoor unit heat exchangers 71 through the on-off valves 84. The high-temperature gas refrigerant is condensed in the indoor unit heat exchangers 71, has its pressure reduced in the indoor unit expansion devices 72 to become intermediate-pressure liquid refrigerant, and flows into the branch unit intermediate-pressure channel 20*c*. Then, the intermediate-pressure liquid refrigerant that has flowed into the branch unit intermediate-pressure channel 20*c* is reused in the refrigerant indoor units 70 that perform a cooling operation.

To cope with uneven distribution of cooling loads among a plurality of branch units as described above in Embodiment 1, intermediate-pressure refrigerant is moved through the intermediate-pressure refrigerant pipe 2*c*. Thus, in a case where intermediate-pressure refrigerant is in short in the third branch unit 1*c*, intermediate-pressure refrigerant is supplied from the first branch unit 1*a* through the intermediate-pressure refrigerant pipe 2*c*.

[Mollier Chart in Cooling Main Operation Mode]

A Mollier chart showing the refrigeration cycle apparatus according to Embodiment 2 in the cooling main operation mode will be described with reference to FIG. 9.

The Mollier chart of FIG. 9 shows an example in which intermediate-pressure refrigerant is distributed by using the intermediate-pressure refrigerant pipe 2*c* to adjust excess and shortage of a cooling load between the first branch unit 1*a* and the third branch unit 1*c*. In this example, a cooling load of the first branch unit 1*a* is larger than that of the third branch unit 1*c*, and intermediate-pressure refrigerant is supplied from the third branch unit 1*c* to the first branch unit 1*a* where intermediate-pressure refrigerant is in short.

In this example, a pressure loss of refrigerant caused by the refrigerant pipes of the refrigeration cycle apparatus according to Embodiment 2 illustrated in FIG. 6 is taken into consideration.

That is, the Mollier chart shows a pressure loss in which pipe lengths and height differences among pipes in arrangement of the outdoor unit 100, the first branch unit 1*a*, and the third branch unit 1*c* illustrated in FIG. 6 are taken into consideration.

As described above, in the refrigeration cycle apparatus according to Embodiment 2, the third branch unit 1*c* has a refrigerant pipe length larger than that of the first branch unit 1*a* by B [m] with respect to the outdoor unit 100, and is disposed at a location higher than the first branch unit 1*a* by D [m]. A refrigerant pipe length connecting the outdoor unit 100 and the first branch unit 1*a* to each other is A [m], and a height difference between the outdoor unit 100 and the first branch unit 1*a* is C [m].

A change of state of the refrigeration cycle apparatus according to Embodiment 1 will be described with reference to the Mollier chart of FIG. 9.

Gas refrigerant that has been compressed to become high-temperature high-pressure refrigerant in the compressor 50 partially rejects heat to the air at a condensing temperature Tc in the outdoor heat exchanger 52. Then, the refrigerant is subjected to a pipe pressure loss downward along a Y axis (pressure axis) on the Mollier chart of FIG. 9 in the high-pressure refrigerant pipe 2*a* (with a length of A [m] and a height difference of C [m]) between the compressor 50 and the first branch unit 1*a* to have its pressure reduced (corresponding to a first pressure drop portion 60), and branches off into the first branch unit 1*a* and the third branch unit 1*c*. The refrigerant flowing toward the third branch unit 1*c* is also subjected to a pipe pressure loss in a high-pressure refrigerant pipe 2*a* (with a length of B [m] and a height difference of D [m]) between the first branch unit 1*a* and the third branch unit 1*c* to have its pressure reduced (corresponding to a second pressure drop portion 61) downward along the Y axis on the Mollier chart. In this pressure state, the high-pressure gauge PS1 [1*a*] in the first branch unit 1*a* and the high-pressure gauge PS1 [1*c*] in the third branch unit 1*c* detect condensing pressures.

High-pressure refrigerant that has flowed into the intermediate heat exchanger 3*a* and the indoor unit heat exchanger 71 serving as condensers in the first branch unit 1*a* and the third branch unit 1*c* heats a secondary heat medium to be condensed, and moves to the left across a saturated liquid line on the Mollier chart to be subcooled.

As shown in the Mollier chart, the condensing temperature of the indoor unit heat exchanger 71 connected to the third branch unit 1*c* is lower than the intermediate heat exchanger 3*a* of the first branch unit 1*a* by a degree corresponding to a pipe pressure loss of refrigerant (indicated by the second pressure drop portion 61).

State points of outlet refrigerant of the intermediate heat exchanger 3*a* and the indoor unit heat exchanger 71 serving as condensers are indicated by points 7*a* and 72-1 (refrigerant inlet locations of the expansion devices 7*a* and 72-1 corresponding to condensers). As described above, degrees of subcooling of the heat exchangers 3*a* and 71 are adjusted by the expansion devices 7*a* and 72. Then, the refrigerant becomes intermediate-pressure refrigerant and flows into the branch unit intermediate-pressure channel 20*c*. The intermediate-pressure refrigerant in the first branch unit 1*a* and the third branch unit 1*c* expands in expansion devices 8*a* and 72-2 corresponding to evaporators, and becomes low-temperature low-pressure two-phase refrigerant.

The pressure of the intermediate-pressure refrigerant is adjusted by the expansion devices 8*a* and 72-2. In this example, since a cooling load of the first branch unit 1*a* is relatively large, the second expansion device 8*a* associated with the intermediate heat exchanger 4*a* serving as an evaporator in the first branch unit 1*a* needs to be adjusted so that the pressure of intermediate-pressure liquid refrigerant in the first branch unit 1*a* detected by the intermediate-pressure gauge PS2 [1*a*] is smaller than the pressure of intermediate-pressure liquid refrigerant in the third branch unit 1*c* detected by the intermediate-pressure gauge PS2 [1*c*], in order to supply intermediate-pressure liquid refrigerant from the intermediate third branch unit 1*c* to the first branch unit 1*a*.

The second expansion device 8*a* is adjusted in the manner described above so that the pressure of intermediate-pressure liquid refrigerant in the first branch unit 1*a* is lower than that of intermediate-pressure liquid refrigerant in the third branch unit 1*c* as shown in FIG. 9, and intermediate-pressure liquid refrigerant is supplied from the third branch unit 1*c* to the first branch unit 1*a* through the intermediate-pressure refrigerant pipe 2*c*.

The refrigerant evaporates and becomes low-pressure gas refrigerant in the intermediate heat exchangers 4*a* and 71-2 serving as evaporators, thereby cooling the secondary heat medium. Thereafter, the pressure of refrigerant is further reduced and with a pipe pressure loss occurring in the low-pressure refrigerant pipe 2*b*, and is sucked into the compressor 50.

A differential pressure for control in the expansion device 72-1 of the indoor unit heat exchanger 71 in a case where the third branch unit 1*c* has a heating load in the refrigeration cycle apparatus described above will be described.

In general, to control a flow rate of fluid, an expansion device is selected with a minimum control differential pressure being obtained across fluid to pass therethrough.

In a case where the third branch unit 1*c* has a heating load in adjusting the second expansion device 8*a* to have a pressure detected by the intermediate-pressure gauge PS2 [1*a*] of the first branch unit 1*a* smaller than a pressure detected by the intermediate-pressure gauge PS2 [1*b*] of the second branch unit 1*b*, a flow rate of the high-temperature gas refrigerant is controlled by the expansion device 72-1 of the indoor unit heat exchanger 71 serving as a condenser, and thus, a minimum control differential pressure EXm (e.g., 1.5 [kgf/cm$^2$]) needs to be obtained in the expansion device 72-1.

Thus, a differential pressure between the point 72-1 (a condensing pressure at the inlet of the indoor unit expansion device 72) and the point 72-2 (an intermediate-pressure refrigerant pressure at the inlet of the indoor unit expansion device 72) on the Mollier chart of FIG. 4 needs to be obtained as a minimum control differential pressure EXm of the indoor unit expansion device 72-1 to serve as a condenser. That is, the differential pressure between the pressure detected by the high-pressure gauge PS1 [1*b*] and the pressure detected by the intermediate-pressure gauge PS2 [1*c*] needs to be obtained as a minimum control differential pressure EXm.

To obtain this pressure, in controlling the second expansion device 8*a*, the minimum control differential pressure EXm of the expansion device 72-1 needs to be obtained in consideration of a second pressure drop portion 61 that is a pipe pressure loss in the high-pressure refrigerant pipe 2*a* between the first branch unit 1*a* and the third branch unit 1*c* and a third pressure drop portion 62 for allowing intermediate-pressure liquid refrigerant to flow from the second branch unit 1*b* to the first branch unit 1*a* through the intermediate-pressure refrigerant pipe 2*c*.

Thus, the differential pressure between the high-pressure gauge PS1 [1*a*] and the intermediate-pressure gauge PS2 [1*a*] needs to be greater than or equal to a sum (differential pressure ΔPHM) of the differential pressure (minimum control differential pressure EXm) between the high-pressure gauge PS1 [1*c*] and the intermediate-pressure gauge PS2 [1*c*], the differential pressure (second pressure drop portion 61) between the high-pressure gauge PS1 [1*a*] and the high-pressure gauge PS1 [1*c*], and the differential pressure (third pressure drop portion 62) between the intermediate-pressure gauge PS2 [1*c*] and the intermediate-pressure gauge PS2 [1*a*]. Accordingly, to make the differential pressure between the high-pressure gauge PS1 [1*a*] and the intermediate-pressure gauge PS2 [1*a*] be greater than or equal to the set value (differential pressure ΔPHM), the second expansion device 8*a* associated with the intermediate heat exchanger 4*a* serving as an evaporator in the first branch unit 1*a* is controlled.

In other words, the second expansion device 8*a* associated with the intermediate heat exchanger 4*a* serving as an evaporator in the first branch unit 1*a* having a smaller pipe pressure loss from the outdoor unit 100 is controlled in such a manner that a differential pressure between a refrigerant pressure detected by the high-pressure gauge PS1 [1*a*] of the first branch unit 1*a* having a small pipe pressure loss from the outdoor unit 100 and a refrigerant pressure detected by the intermediate-pressure gauge PS2 [1*a*] is greater than or equal to a set value (differential pressure ΔPHM) in which a minimum control differential pressure of the expansion device 72-1 to serve as a condenser and associated with the indoor unit heat exchanger 71 connected to the third branch unit 1*c* having a large pipe pressure loss from the outdoor unit 100 is taken into consideration.

The opening degree of the second expansion device 8*a* is controlled as described above so that high-pressure gas refrigerant can be supplied to the condenser 71 of the indoor unit connected to the third branch unit 1*c* having a larger pipe pressure loss from the outdoor unit 100 than the first branch unit 1*a* and the minimum control differential pressure EXm of the expansion device 72-1 to serve as a condenser can be obtained.

In the above example, both the first branch unit 1*a* and the third branch unit 1*c* are in the cooling main operation mode. In a case where the first branch unit 1*a* has at least a cooling load and the third branch unit 1*c* has at least a heating load, control for obtaining a minimum control differential pressure EXm of the expansion device 72-1 to serve as a condenser is needed.

In the above example, the combination of the first branch unit 1*a* and the third branch unit 1*c* is used. Similar control is also applicable to a refrigeration cycle apparatus including only a plurality of third branch units 1*c*.

The expansion device associated with the intermediate heat exchanger serving as an evaporator in the branch unit having the minimum pipe pressure loss is controlled in the manner described above so that high-pressure gas refrigerant can be supplied to a condenser in a branch unit having the maximum pipe pressure loss and a minimum control pressure of the expansion device associated with the condenser can be obtained.

In addition, plurality of branch units are connected in parallel to the outdoor unit 100 so that a large number of indoor units can be connected to selectively perform cooling and heating operations, the configuration of refrigerant pipes and crossover wiring for control can be simplified as compared to a conventional configuration in which a main branch unit and sub-branch units are serially connected to an outdoor unit 100, and the amount of enclosed refrigerant can be reduced.

REFERENCE SIGNS LIST

1*a* first branch unit, 1*b* second branch unit, 1*c* third branch unit, 2*a* high-pressure refrigerant pipe, 2*b* low-pressure refrigerant pipe, 2*c* intermediate-pressure refrigerant pipe, 3*a* intermediate heat exchanger, 3*b* intermediate heat exchanger, 4*a* intermediate heat exchanger, 4*b* intermediate heat exchanger, 5*a* first refrigerant flow switching device, 6*a* second refrigerant flow switching device, 7*a* first expansion device, 7*b* first expansion device, 8*a* second expansion device, 8*b* second expansion device, 9*a* third expansion device, 12 an on-off valve, 12*b* on-off valve, 20*a* branch unit high-pressure channel, 20*b* branch unit low-pressure channel, 20*c* branch unit intermediate-pressure channel, 20*d* branch unit bypass channel, 30 indoor unit (use side unit), 31 heat medium transfer device, 31*a* heat medium transfer device, 31*b* heat medium transfer device, 32 heat medium flow switching device, 33 heat medium flow switching device, 34 heat medium flow control device, 50 compressor, 51 refrigerant flow switching device, 52 outdoor heat exchanger, 53 accumulator, 54*a* check valve, 54*b* check valve, 54*c* check valve, 54*d* check valve, 60 first pressure drop portion, 61 second pressure drop portion, 62 third pressure drop portion, 70 refrigerant indoor unit, 71 indoor unit heat exchanger, 72 indoor unit expansion device, 80 expansion device, 81 subcooling heat exchanger, 83 on-off valve, 84 on-off valve, 85 check valve, 86 check valve, 100 outdoor unit (heat source unit).

The invention claimed is:

1. A refrigeration cycle apparatus comprising:

a heat source unit including a compressor and an outdoor heat exchanger;

a plurality of branch units each including a plurality of intermediate heat exchangers configured to heat exchange between refrigerant and a heat medium and a plurality of expansion devices for refrigerant corresponding the intermediate heat exchangers;

a plurality of use side units that receive the heat medium from the branch units;

a refrigerant circuit including a high-pressure refrigerant pipe, a low-pressure refrigerant pipe, and an intermediate-pressure refrigerant pipe, the high-pressure refrigerant pipe and the low-pressure refrigerant pipe respectively connecting the heat source unit to each of the branch units, the intermediate-pressure refrigerant pipe connecting the branch units to each other;

a plurality of high-pressure detecting devices including a high-pressure detecting device provided in each of the branch units configured to detect a pressure of the refrigerant passing through the high-pressure refrigerant pipe; and a plurality of intermediate-pressure detecting devices including an intermediate-pressure detecting device provided in each of the branch units configured to detect a pressure of the refrigerant passing through the intermediate-pressure refrigerant pipe, at least one of the branch units being a first branch unit having a minimum pressure loss in distribution of refrigerant in the high-pressure refrigerant pipe connecting the heat source unit to the first branch unit, at least another of the branch units being a second branch unit having a maximum pressure loss in distribution of refrigerant in the high-pressure refrigerant pipe connecting the heat source unit to the second branch unit, at least one of the plurality of the expansion devices is configured to have an opening degree which allows a differential pressure between a refrigerant pressure detected by the high-pressure detecting device of the first branch unit and a refrigerant pressure detected by the intermediate-pressure detecting device of the first branch unit is greater than or equal to a set value.

2. The refrigeration cycle apparatus of claim 1, wherein the opening degree of the at least one of the plurality of the expansion devices is controlled in such a manner that a refrigerant pressure detected by the intermediate-pressure detecting device of the first branch unit is lower than a refrigerant pressure detected by the intermediate-pressure detecting device of the second branch unit.

3. The refrigeration cycle apparatus of claim 1, wherein the at least one of the plurality of the expansion devices is an expansion device corresponding at least one of the intermediate heat exchangers that performs a cooling operation among the plurality of the intermediate heat exchangers of the first branch unit.

4. The refrigeration cycle apparatus of claim 1, wherein the opening degree of the at least one of the expansion devices is controlled in a case where the intermediate heat exchangers of the first branch unit perform a mixed operation as a combination of a cooling operation and a heating operation and at least one of the intermediate heat exchangers of the second branch unit performs a heating operation.

5. The refrigeration cycle apparatus of claim 4, wherein the opening degree of the at least one of the plurality of the expansion devices is controlled in a case where a capacity of one of the intermediate heat exchangers of the first branch unit that performs a cooling operation is larger than a capacity of another of the intermediate heat exchangers of the first branch unit that performs a heating operation.

6. The refrigeration cycle apparatus of claim 1, wherein the first branch unit is disposed at a location lower than the second branch unit.

7. The refrigeration cycle apparatus of any one of claim 1, wherein a length of the high-pressure refrigerant pipe between the first branch unit and the heat source unit is smaller than a length of the high-pressure refrigerant pipe between the second branch unit and the heat source unit.

* * * * *